US012672745B2

(12) United States Patent
Philippe et al.

(10) Patent No.: US 12,672,745 B2
(45) Date of Patent: Jul. 7, 2026

(54) VACUUM CLEANER NOZZLE PROVIDED WITH A V-SHAPED FRONT SCRAPING MEMBER

(71) Applicant: SEB S.A., Ecully (FR)

(72) Inventors: Christelle Philippe, Ecully (FR); Jean Damien Vivier, Ecully (FR); Adrien Zanni, Ecully (FR)

(73) Assignee: SEB S.A., Ecully (FR)

( * ) Notice: Subject to any disclaimer, the term of this patent is extended or adjusted under 35 U.S.C. 154(b) by 342 days.

(21) Appl. No.: 18/294,794

(22) PCT Filed: Aug. 2, 2022

(86) PCT No.: PCT/FR2022/051545
§ 371 (c)(1),
(2) Date: Feb. 2, 2024

(87) PCT Pub. No.: WO2023/012434
PCT Pub. Date: Feb. 9, 2023

(65) Prior Publication Data

US 2024/0335075 A1 Oct. 10, 2024

(30) Foreign Application Priority Data

Aug. 4, 2021 (FR) ..... 2108478

(51) Int. Cl.
*A47L 9/06* (2006.01)

(52) U.S. Cl.
CPC ..... *A47L 9/066* (2013.01)

(58) Field of Classification Search
CPC ..... A47L 9/066; A47L 9/06
See application file for complete search history.

(56) References Cited

U.S. PATENT DOCUMENTS 2,824,334 A * 2/1958 Laningham ..... A47L 9/0673 15/325
2010/0319159 A1* 12/2010 Gell ..... A47L 9/0606 15/415.1
2012/0000033 A1* 1/2012 Conrad ..... A47L 9/02 15/415.1

FOREIGN PATENT DOCUMENTS

CN 101953665 A * 1/2011 ..... A47L 9/06
DE 19933449 C1 * 11/2000 ..... A47L 9/06
(Continued)

OTHER PUBLICATIONS

International Search Report for PCT/FR2022/051545 mailed Nov. 21, 2022. 3 pages.

*Primary Examiner* — Marc Carlson
(74) *Attorney, Agent, or Firm* — Lerner David LLP

(57) ABSTRACT

A vacuum cleaner nozzle includes a sole provided with a lower face and a suction channel emerging into the lower face; and a front scraping member located at the front of a front edge of the suction channel and delimiting at least in part a central passage opening which is fluidly connected to the suction channel. The front scraping member generally has a V shape having an apex oriented towards a central part of the suction channel, the front scraping member including a first scraping branch extending in a first direction of extension and a second scraping branch extending in a second direction of extension, the first and second scraping branches being configured to orient waste, coming into contact against the front scraping member during a forward movement of the vacuum cleaner nozzle towards the central passage opening.

15 Claims, 3 Drawing Sheets

(56) References Cited

FOREIGN PATENT DOCUMENTS

| | | | | | |
|---|---|---|---|---|---|
| EP | 2201876 | A1 | * | 6/2010 | ..... A47L 5/28 |
| EP | 2457481 | A1 | * | 5/2012 | ..... A47L 9/02 |
| EP | 3095369 | A1 | * | 11/2016 | ..... A47L 9/0693 |
| EP | 3718453 | A1 | * | 10/2020 | ..... A47L 9/009 |
| FR | 2958143 | A1 | * | 10/2011 | ..... A47L 9/0606 |
| FR | 3078877 | A1 | * | 9/2019 | ..... A47L 9/066 |
| FR | 3080016 | A1 | * | 10/2019 | ..... A47L 9/02 |
| WO | WO-2010146382 | A1 | * | 12/2010 | ..... A47L 9/0606 |
| WO | 2023012434 | A1 | | 2/2023 | |

* cited by examiner

VACUUM CLEANER NOZZLE PROVIDED WITH A V-SHAPED FRONT SCRAPING MEMBER

CROSS-REFERENCE TO RELATED APPLICATIONS

The present application is a national phase entry under 35 U.S.C. § 371 of International Application No. PCT/FR2022/051545, filed Aug. 2, 2022, published in French, which claims priority to French Application No. 2108478 filed Aug. 4, 2021, all the disclosures of which are incorporated herein by reference in their entireties.

TECHNICAL FIELD

The present invention concerns the field of vacuum cleaners equipped with a vacuum cleaner nozzle, also called suction head, making it possible to suck up dust and waste present on a surface to be cleaned, which may for example be tiles, parquet or laminate.

STATE OF THE ART

Document EP3095369 describes a vacuum cleaner nozzle comprising:

- a sole provided with a lower face configured to be oriented towards a surface to be cleaned and a suction channel emerging into the lower face of the sole, and
- a front scraping member located at the front of a front edge of the suction channel, the front scraping member having a generally V-shape having an apex oriented towards a central part of the suction channel, the front scraping member including a first scraping branch which is elongated and which extends in a first direction of extension and a second scraping branch which is elongated and which extends in a second direction of extension.

The first and second scraping branches delimit at least in part a central passage opening which is fluidly connected to the suction channel so as to allow a suction of waste through the central passage opening and towards the suction channel, and are configured to orient waste, coming into contact against the front scraping member during a forward movement of the vacuum cleaner nozzle, towards the central passage opening.

The first and second directions of extension are inclined relative to each other by an angle of inclination of approximately 135°.

Such an angle of inclination makes it possible to channel large waste, coming into contact against the front scraping member during a forward movement of the vacuum cleaner nozzle, towards the central passage opening in view of their suction, and also to ensure a rapid movement of this large waste towards the central passage opening. Thus, such a vacuum cleaner nozzle ensures a rapid and efficient suction of large waste present on a surface to be cleaned.

However, such a configuration of the front scraping member is likely to cause an accumulation of large waste at the central passage opening, in the event of the presence of a significant quantity of large debris on the surface to be clean, and therefore impair the suction efficiency of the suction nozzle.

To overcome this drawback, it may be considered to increase the width of the central passage opening. However, the presence of a large size central passage opening induces suction losses at the suction channel which are detrimental for the suction of very small waste, such as dust or flour, on hard floor.

Furthermore, such an angle of inclination of the first and second directions of extension has the disadvantage of giving the vacuum cleaner nozzle a large frontal bulk, such that it is not easy to suck, with such a vacuum cleaner nozzle, waste located for example along a wall or a plinth.

SUMMARY OF THE INVENTION

The present invention aims to remedy these drawbacks.

The technical problem underlying the invention consists in particular of providing a vacuum cleaner nozzle which is simple and compact in structure, while allowing an effective suction of dust and large waste, such as grains of rice or lentils, present on a surface to be cleaned.

For this purpose, the invention relates to a vacuum cleaner nozzle comprising:

- a sole provided with a lower face configured to be oriented towards a surface to be cleaned and a suction channel emerging into the lower face of the sole,
- a front scraping member located at the front of a front edge of the suction channel and delimiting at least in part a central passage opening which is fluidly connected to the suction channel so as to allow a suction of waste through the central passage opening and in the direction of the suction channel, the front scraping member having a generally V-shape having an apex oriented towards a central part of the suction channel, the front scraping member including a first scraping branch which is elongated and which extends in a first direction of extension and a second scraping branch which is elongated and which extends in a second direction of extension, the first and second scraping branches being configured to orient waste, coming into contact with the front scraping member during a forward movement of the vacuum cleaner nozzle, towards the central passage opening.

The first and second directions of extension are inclined relative to each other by an angle of inclination comprised between 165° and 178°, and advantageously between 170 and 178°, and for example approximately 176°.

By scraping member is meant any member, such as a brush or a squeegee, which, when the vacuum cleaner nozzle passes over a floor to be cleaned, rubs on the floor to promote the cleaning of the latter.

The specific inclination of the first and second scraping branches according to the present invention is defined to ensure a sliding, towards the central passage opening, of large waste, such as grains of rice or lentils, coming into contact against the scraping member during a forward movement of the vacuum cleaner nozzle, while limiting the speed of movement of this waste towards the central passage opening.

Thus, the vacuum cleaner nozzle according to the present invention limits the risks of accumulation of waste at the central passage opening without requiring an oversizing of the central passage opening.

Furthermore, the specific inclination of the first and second scraping branches according to the present invention substantially limits the frontal bulk of the vacuum cleaner nozzle, and therefore ensures an effective suction of waste located along a wall or a plinth.

The vacuum cleaner nozzle may also have one or more of the following characteristics, taken alone or in combination.

According to one embodiment of the invention, the front scraping member includes the central passage opening.

According to one embodiment of the invention, the front scraping member includes at least one first lateral passage opening which is provided on the first scraping branch and which is fluidly connected to the suction channel, and at least one second lateral passage opening which is provided on the second scraping branch and which is fluidly connected to the suction channel, the at least one first lateral passage opening and the at least one second lateral passage opening being disposed on either side of the central passage opening. The presence of the at least one first lateral passage opening and of the at least one second lateral passage opening makes it possible to further reduce the risks of accumulation of large waste at the central passage opening.

According to one embodiment of the invention, the at least one first lateral passage opening and the at least one second lateral passage opening are disposed symmetrically with respect to the median longitudinal plane of the vacuum cleaner nozzle. Such an arrangement of the at least one first lateral passage opening and of the at least one second lateral passage opening limits turbulence, and therefore the pressure losses, within the suction channel.

According to one embodiment of the invention, the central passage opening has a width less than the width of each of the first and second lateral passage openings. These arrangements make it possible to limit the pressure losses at the central passage opening, and therefore to further reduce the risks of accumulation of waste at the central passage opening.

It will be noted that, in the present document, the term "width" associated with a passage opening corresponds to a dimension of said passage opening measured in a direction transverse to a movement direction of the vacuum cleaner nozzle.

According to one embodiment of the invention, the central passage opening has a height less than the height of the front scraping member.

According to one embodiment of the invention, each of the first and second lateral passage openings has a height less than the height of the front scraping member.

According to one embodiment of the invention, the front scraping member includes a plurality of notched areas distributed along the front scraping member and provided with notches, also called crenels, defining the at least one first lateral passage opening and the at least one second lateral passage opening.

According to one embodiment of the invention, the first scraping branch includes a primary internal branch part having a length corresponding substantially to half the length of the first scraping branch and a primary external branch part having a length corresponding substantially to half the length of the first scraping branch, a first opening rate of the primary internal branch part of the first scraping branch being comprised between 23 and 71%, for example between 30 and 60%, and advantageously between 40 and 50%, the first opening rate being defined by the ratio between the length of the notched area or the sum of the lengths of the notched areas provided on the primary internal branch part of the first scraping branch and half the length of the first scraping branch, and the second scraping branch includes a secondary internal branch part having a length corresponding substantially to half the length of the second scraping branch and a secondary external branch part having a length corresponding substantially to half the length of the second scraping branch, a second opening rate of the secondary internal branch part of the second scraping branch being comprised between 23 and 71%, for example between 30 and 60%, and advantageously between 40 and 50%, the second opening rate being defined by the ratio between the length of the notched area or the sum of the lengths of the notched areas provided on the secondary internal branch part of the second scraping branch and half the length of the second scraping branch. These arrangements make it possible to further reduce the risks of accumulation of waste at the central passage opening.

According to one embodiment of the invention, the central passage opening is delimited at least in part by the first and second scraping branches.

According to one embodiment of the invention, the central passage opening is delimited at least in part by two notches provided respectively on the first and second scraping branches.

According to another embodiment of the invention, the first and second scraping branches are spaced apart, and the central passage opening is delimited at least in part by internal edges of the first and second scraping branches.

According to one embodiment of the invention, the front scraping member includes a plurality of scraping areas distributed along the front scraping member and configured to scrape the surface to be cleaned.

According to one embodiment of the invention, the plurality of scraping areas includes a plurality of first scraping areas distributed along the first scraping branch, and a plurality of second scraping areas distributed along the second scraping branch.

According to one embodiment of the invention, the first scraping branch includes an alternation of notched areas and first scraping areas, and the second scraping branch includes an alternation of notched areas and second scraping areas.

According to one embodiment of the invention, the sum of the lengths of the first scraping areas is greater than 50%, and for example greater than 70%, of the length of the first scraping branch, and the sum of the lengths of the second scraping areas is greater than 50%, and for example greater than 70%, of the length of the second scraping branch. These arrangements make it possible to ensure a satisfactory scraping of the surface to be cleaned, while limiting the suction losses, particularly on hard floor.

According to one embodiment of the invention, the central passage opening has a width comprised between 1 and 2 cm, and for example between 1.2 and 1.5 cm.

According to one embodiment of the invention, each of the first and second scraping branches is rectilinear.

According to one embodiment of the invention, the front scraping member is a front scraping brush.

According to one embodiment of the invention, the front scraping brush is formed by a plurality of bristles or bristle tufts.

According to another embodiment of the invention, the front scraping member is formed of a flexible material.

According to one embodiment of the invention, the first and second scraping branches are distinct and separated from each other. These arrangements make it easier to fasten the front scraping member on its support, while avoiding any risk of deformation of this support. Indeed, the use of a front scraping member folded into a V-shape would be likely to cause a deformation of the support on which the front scraping member is fastened.

According to another embodiment of the invention, the first and second scraping branches are connected to each other.

According to one embodiment of the invention, the front scraping member extends along the front edge of the suction channel.

According to one embodiment of the invention, the front scraping member has a length greater than at least 70%, and for example greater than at least 80%, of the width of the sole.

According to one embodiment of the invention, the first end of the front scraping member is located near a first lateral edge of the sole, and the second end of the front scraping member is located near a second lateral edge of the sole.

According to one embodiment of the invention, the front scraping member is movable between a lowered position in which the front scraping member projects from the lower face of the sole and is configured to be in contact with the surface to be cleaned and a raised position in which the front scraping member is located back from the lower face of the sole and is configured to be located at a distance from the surface to be cleaned.

According to one embodiment of the invention, the front scraping member is mounted on a support movably mounted, and for example slidably, on the sole.

According to one embodiment of the invention, each of the first and second scraping branches has a length comprised between 10 and 16 cm, and for example approximately 13 cm.

According to one embodiment of the invention, the front scraping member has a thickness comprised between 3 and 7 mm.

According to one embodiment of the invention, the front scraping member includes a lower edge which extends substantially horizontally when the vacuum cleaner nozzle rests on a horizontal surface.

According to one embodiment of the invention, the vacuum cleaner nozzle comprises a rear scraping member, such as a rear scraping brush, located at the rear of a rear edge of the suction channel.

According to one embodiment of the invention, the rear scraping member extends along the rear edge of the sole.

According to one embodiment of the invention, the rear scraping member includes a central part extending substantially parallel to the direction of extension of the suction channel, and a first lateral portion and a second lateral portion disposed on either side of the central part of the rear scraping member, the first and second lateral portions diverging relative to each other in the direction of a rear edge of the sole.

According to one embodiment of the invention, the suction channel extends in a direction of extension which is transverse to a movement direction of the vacuum cleaner nozzle.

According to one embodiment of the invention, each of the first and second directions of extension is inclined relative to the direction of extension of the suction channel by an angle of inclination comprised between 1 and 7.5°, and for example between 1 and 5°.

According to one embodiment of the invention, the first and second scraping branches are disposed symmetrically with respect to a median longitudinal plane of the vacuum cleaner nozzle.

According to one embodiment of the invention, the front scraping member includes a first end and a second end which are opposite to each other, the first and second ends of the front scraping member being further away from the suction channel than the central part of the front scraping member.

According to one embodiment of the invention, the vacuum cleaner nozzle includes a fork hingedly mounted on the sole through a front pivot link defining a front pivot axis which extends transversely to a movement direction of the vacuum cleaner nozzle.

According to one embodiment of the invention, the vacuum cleaner nozzle include two main wheels intended to roll on a surface to be cleaned, the two main wheels being movably mounted in rotation on the fork about a wheel axis which is substantially parallel to the front pivot axis.

According to one embodiment of the invention, the vacuum cleaner nozzle includes a connecting sleeve to which a suction tube of a vacuum cleaner is intended to be fastened, the connecting sleeve being fluidly connected to the suction channel.

According to one embodiment of the invention, the connecting sleeve is hingedly mounted on the connecting member relative to the fork through a rear pivot link defining a rear pivot axis which is substantially parallel to the front pivot axis.

According to one embodiment of the invention, the vacuum cleaner nozzle includes a flexible connecting conduit fluidly connecting the suction channel to the connecting sleeve.

According to the embodiment represented on the figures, the front scraping member includes a single first lateral passage opening and a single second lateral passage opening. Advantageously, the first lateral passage opening is closer to the apex of the V shape of the front scraping member than to an external edge of the first scraping branch, and the second lateral passage opening is closer to the apex of the V shape of the front scraping member than to an external edge of the second scraping branch.

The present invention further concerns a domestic vacuum cleaner, such as a canister vacuum cleaner, comprising a vacuum cleaner nozzle according to the present invention.

BRIEF DESCRIPTION OF THE FIGURES

The aims, aspects and advantages of the present invention will be better understood from the description given below of a particular embodiment of the invention presented by way of non-limiting example, with reference to the drawings appended in which.

DETAILED DESCRIPTION

Figure 1:
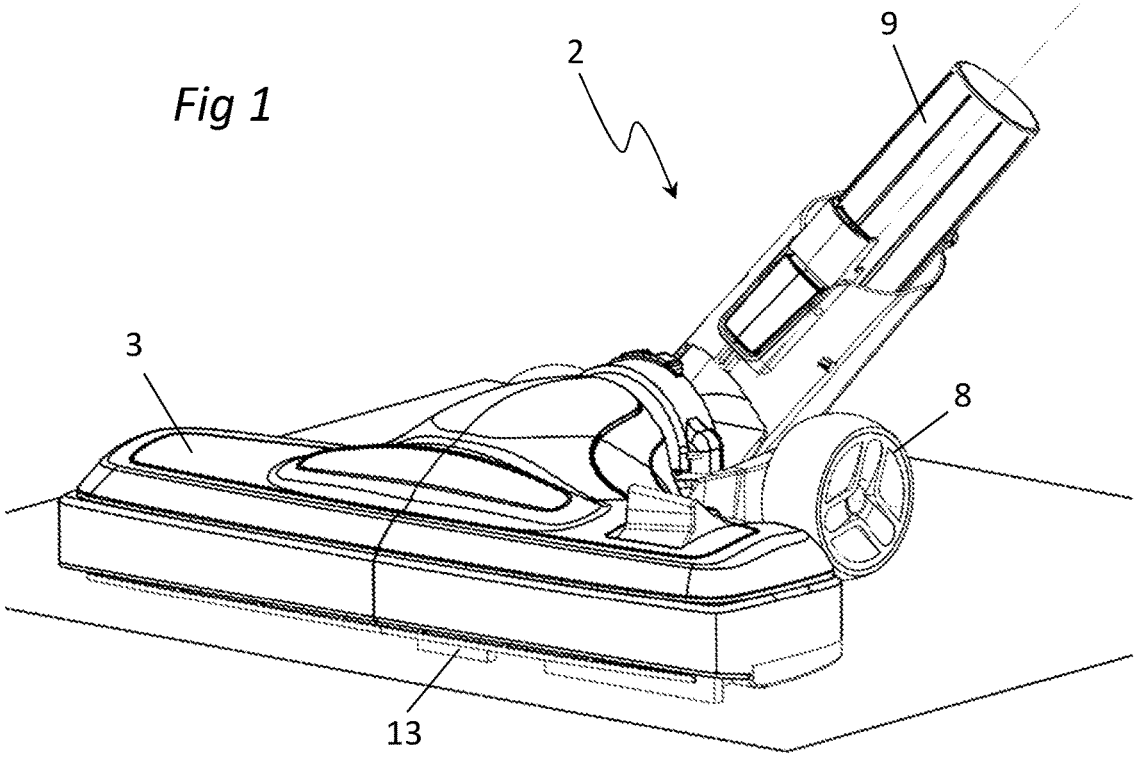
FIG. 1 is a perspective view of a vacuum cleaner nozzle according to the present invention.
Figure 2:
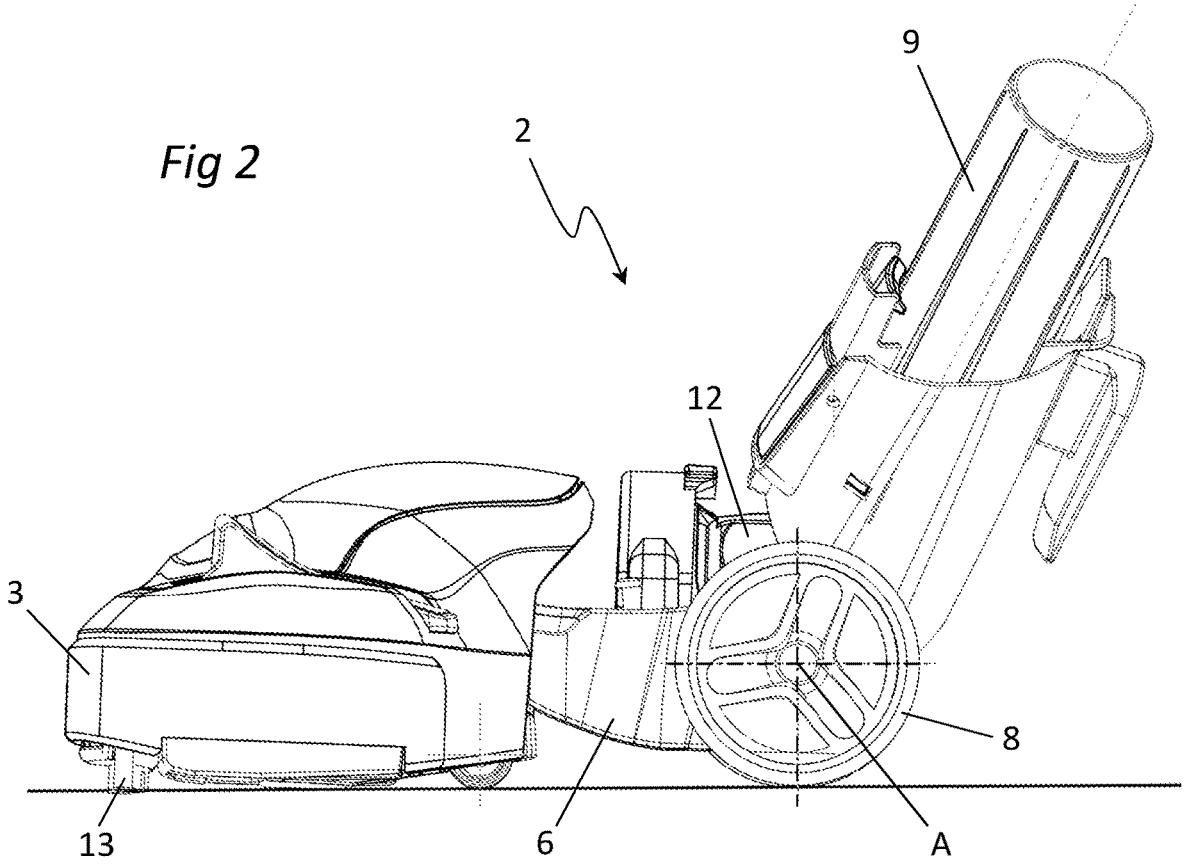
FIG. 2 is a side view of the vacuum cleaner nozzle of FIG. 1.

Only the elements necessary for understanding the invention are represented. To make the drawings easier to read, the same elements bear the same references from one figure to another.

FIGS. 1 to 5 represent a vacuum cleaner nozzle 2 comprising a sole 3 provided with a lower face 4 intended to be positioned adjoining to a surface to be cleaned during the use of the vacuum cleaner nozzle 2.

The sole 3 is also provided with a suction channel 5 emerging onto the lower face 4. Advantageously, the suction channel 5 is elongated and extends in a direction of extension D1 which is transverse to a movement direction D2 of the vacuum cleaner nozzle 2, and for example perpendicular to the movement direction D2.

The vacuum cleaner nozzle 2 further comprises a fork 6 including two fork arms 7 hingedly mounted on the sole 3 through a front pivot link P1 defining a front pivot axis X1 which extends perpendicular to the movement direction D2 of the vacuum cleaner nozzle 2 and which is substantially horizontal when the vacuum cleaner nozzle 2 rests on a horizontal surface. Thus, the fork 6 may tilt backwards or forwards relative to the sole 3.

The vacuum cleaner nozzle 2 also comprises two main wheels 8 intended to roll on the surface to be cleaned. The two main wheels 8 are movably mounted in rotation on the fork 6 about a wheel axis A which is parallel to the front pivot axis X1, and which is therefore also substantially horizontal when the vacuum cleaner nozzle 2 rests on a horizontal surface. Advantageously, the main wheels 8 are disposed on either side of the fork 6.

The vacuum cleaner nozzle 2 further comprises a connecting sleeve 9 at the end of which is connected a tip of a suction tube (not illustrated) itself connected to the suction system of a vacuum cleaner (not illustrated). Various variants of vacuum cleaners already exist on the market and can be used with the vacuum cleaner nozzle 2 according to the invention; these variants being known to those skilled in the art, they are not detailed in the present document.

The vacuum cleaner nozzle 2 also comprises a flexible connecting conduit 11 (see FIG. 4) fluidly connecting the suction channel 5 to the connecting sleeve 9.

The vacuum cleaner nozzle 2 further includes a connecting member 12 mechanically connecting the connecting sleeve 9 to the fork 6.

The connecting sleeve 9 is more particularly hingedly mounted on the connecting member 12 through a rear pivot link P2 defining a rear pivot axis X2 which is parallel to the front pivot axis X1. Thus, the connecting sleeve 9 may tilt backwards or forwards relative to the connecting member 12.

The connecting member 12 is hingedly mounted on the fork 6 through a central pivot link P3 defining an axis of rotation X3 which extends perpendicular to the front pivot axis X1. The central pivot link P3 is located between the rear pivot link P2 and the front pivot link P1, and more particularly between the front pivot link P1 and the wheel axis A. Advantageously, the central pivot link P3 is disposed between the two fork arms 7.

The vacuum cleaner nozzle 2 further comprises a front scraping member 13 located at the front of a front edge 5.1 of the suction channel 5. Advantageously, the front scraping member 13 extends along and near the front edge 5.1 of the suction channel 5, and includes a lower edge 13.1 which extends substantially horizontally when the vacuum cleaner nozzle 2 rests on a horizontal surface.

According to the embodiment represented on the figures, the front scraping member 13 is a front scraping brush which is formed by a plurality of bristles or bristle tufts. However, according to one variant of the invention not represented on the figures, the front scraping member 13 could be formed of a flexible material.

The front scraping member 13 is movable vertically between a lowered position in which the front scraping member 13 projects from the lower face 4 of the sole 3 and is configured to be in contact with the surface to be cleaned, and a raised position in which the front scraping member 13 is located back from the lower face 4 of the sole 3 and is configured to be located at a distance from the surface to be cleaned. The front scraping member 13 may for example be mounted on a support movably mounted, and for example slidably, on the sole 3. However, according to one variant not represented on the figures, the front scraping member 13 could be fastened relative to the sole 3, and project from the lower face 4 of the sole 3.

The front scraping member 13 includes a first end 131 and a second end 132 which are opposite to each other. According to the embodiment represented on the figures, the first end 131 of the front scraping member 13 is located near a first lateral edge 3.1 of the sole 3, and the second end 132 of the front scraping member 13 is located near a second lateral edge 3.2 of the sole 3. Advantageously, the front scraping member 13 has a length greater than at least 80%, and for example greater than 90%, of the width of the sole 3, and a thickness comprised between 3 and 7 mm.

The front scraping member 13 has a V shape having an apex oriented towards a central part of the suction channel 5. In other words, the first and second ends 131, 132 of the front scraping member 13 are further away from the suction channel 5 than the central part of the front scraping member 13.

The front scraping member 13 includes a first scraping branch 14 which is rectilinear and which extends in a first direction of extension De1, and a second scraping branch 15 which is rectilinear and which extends in a second direction of extension De2. Each of the first and second scraping branches 14, 15 may have a length comprised between 10 and 16 cm, and for example approximately 13 cm. Advantageously, the first and second scraping branches 14, 15 are disposed symmetrically with respect to a median longitudinal plane of the vacuum cleaner nozzle 2.

Figure 3:
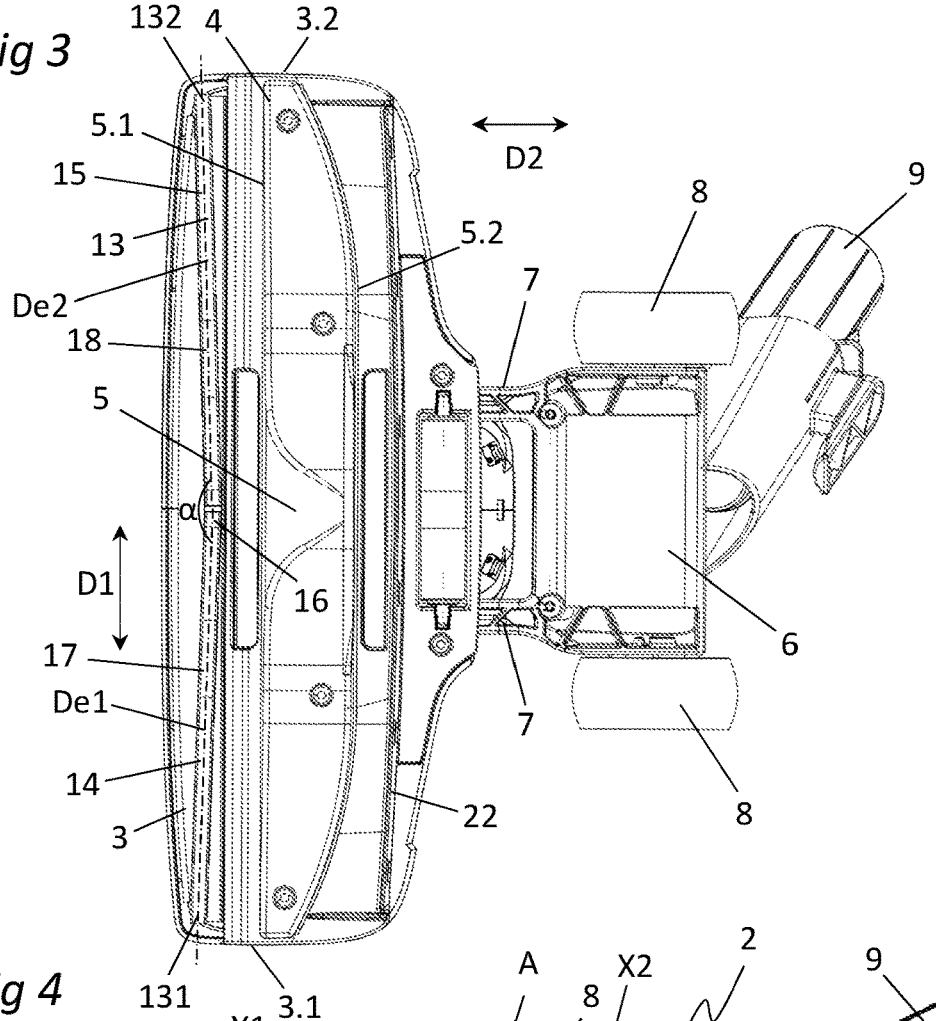
FIG. 3 is a bottom view of the vacuum cleaner nozzle of FIG. 1.
Figure 4:
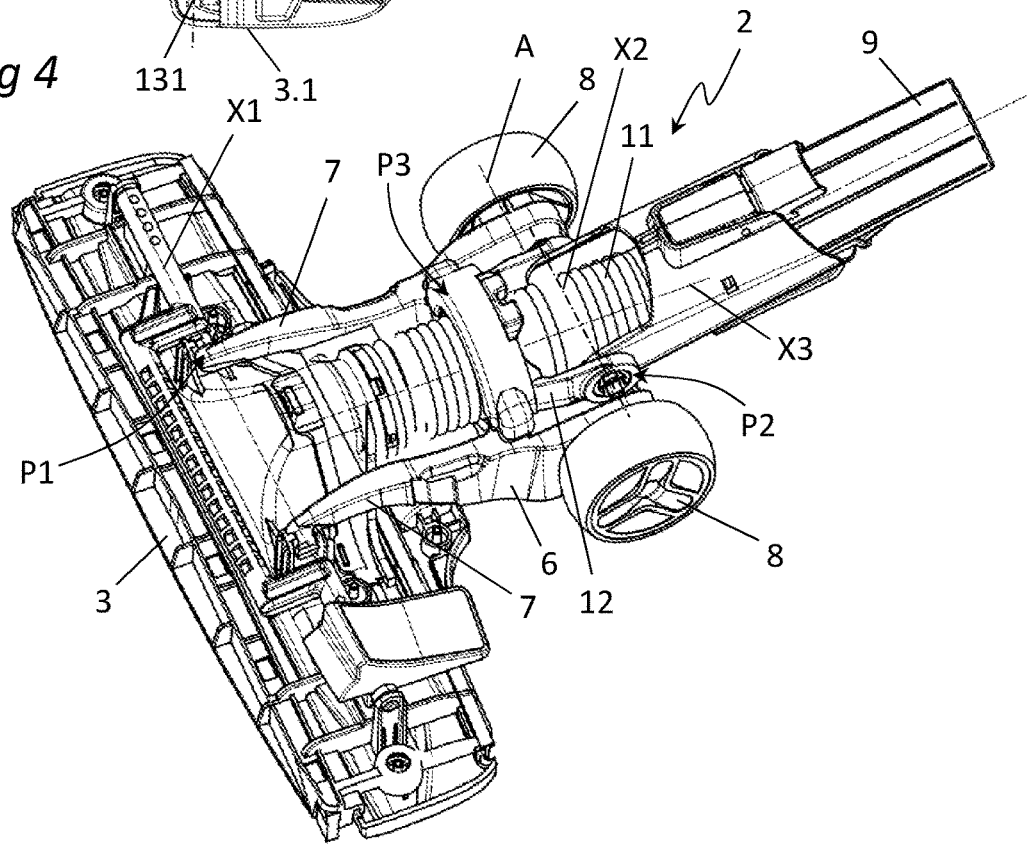
FIG. 4 is a partial perspective view of the vacuum cleaner nozzle of FIG. 1.

As shown more particularly on FIG. 3, the first and second directions of extension De1, De2 are inclined relative to each other by an angle of inclination a comprised between 165° and 178°, and advantageously between 170 and 178°, and for example approximately 176°.

According to the embodiment represented on the figures, the first and second scraping branches 14, 15 are distinct and separated from each other. The sole 3 may for example include a spacer part interposed between the first and second scraping branches 14, 15. However, according to one variant of the invention not represented on the figures, the first and second scraping branches 14, 15 could be connected to each other.

Figure 5:
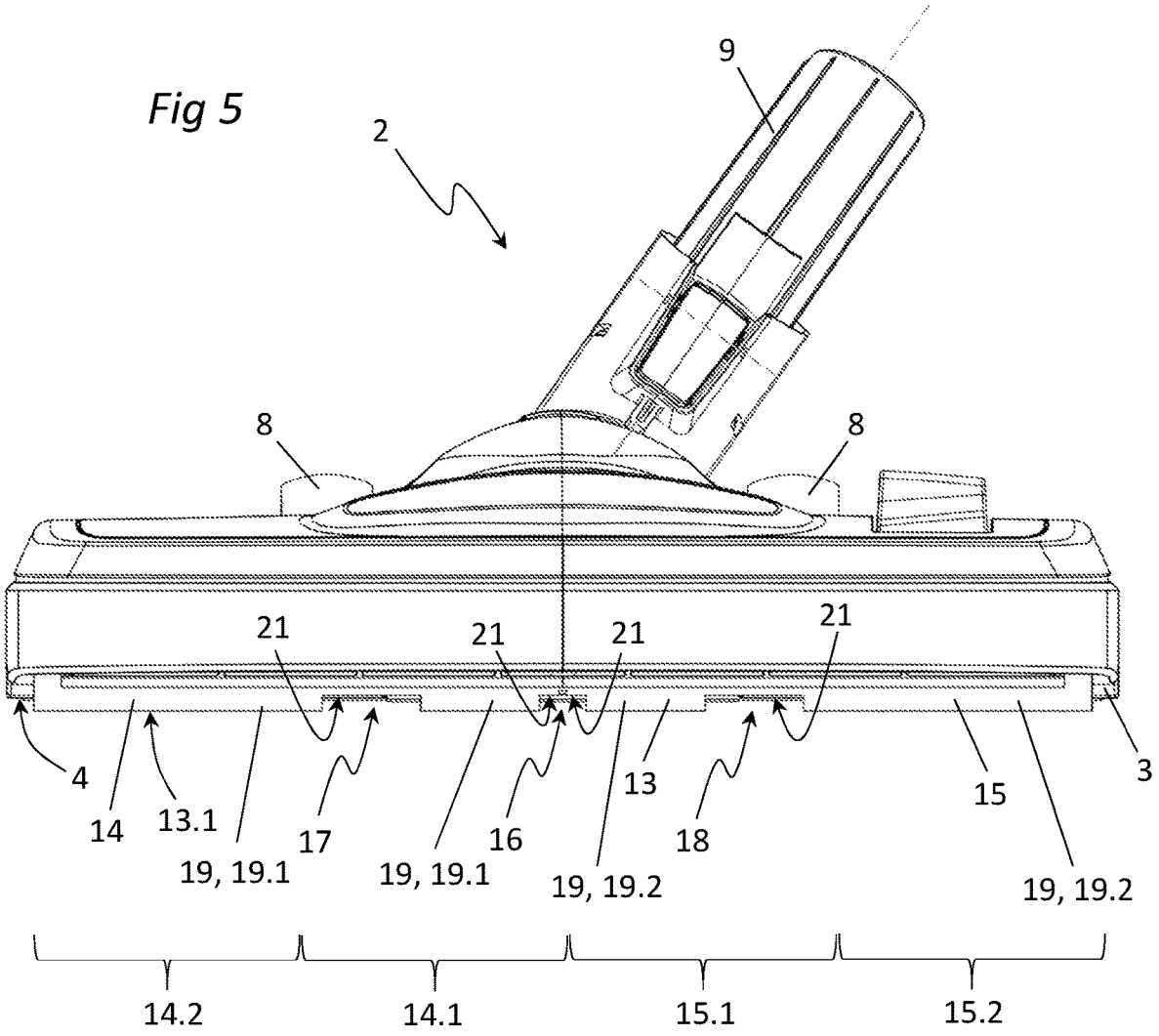
FIG. 5 is a front view of the vacuum cleaner nozzle of FIG. 1.

As shown on FIG. 5, the front scraping member 13 delimits at least in part a central passage opening 16 which is fluidly connected to the suction channel 5, and more particularly to the central part of the suction channel 5, so as to allow waste to be suctioned through the central passage opening 16 and in the direction of the suction channel 5. The central passage opening 16 may for example have a width comprised between 1 and 2 cm, and in particular comprised between 1.2 and 1.5 cm.

The first and second scraping branches 14, 15 are more particularly configured to orient waste, coming into contact against the front scraping member 13 during a forward movement of the vacuum cleaner nozzle 2, towards the central passage opening 16 so that this waste is then sucked through the central passage opening 16.

In order to avoid an accumulation of debris at the central passage opening 16, particularly in the event of the presence of a significant quantity of debris on the surface to be cleaned or large size debris, the front scraping member 13 further delimits at least one first lateral passage opening 17 which is fluidly connected to the suction channel 5, and at least one second lateral passage opening 18 which is also fluidly connected to the suction channel 5. Advantageously, the first and second lateral passage openings 17, 18 are respectively provided on the first and second scraping branches 14, 15.

According to the embodiment represented on the figures, the front scraping member 13 includes a single first lateral passage opening 10 and a single second lateral passage opening 18. Advantageously, the first lateral passage opening 17 is closer to the apex of the V shape of the front scraping member 13 than to an external edge of the first scraping branch 14, and the second lateral passage opening 18 is closer to the apex of the V shape of the front scraping member 13 than to an external edge of the second scraping branch 15.

However, according to one variant of the invention not represented on the figures, the front scraping member 13 could include a plurality of first lateral passage openings 17, for example two, three or more, and a plurality of second lateral passage openings 18, for example two, three or more.

Advantageously, the first lateral passage opening(s) 17 and the second lateral passage opening(s) 18 are disposed on either side of the central passage opening 16, and are more particularly disposed symmetrically with respect to the median longitudinal plane of the vacuum cleaner nozzle 2.

According to the embodiment represented on the figures, the central passage opening 16 has a width less than the width of each of the first and second lateral passage openings 17, 18. The width of the central passage opening 16 could for example be comprised between 30 and 70%, and advantageously between 40 and 60%, and for example be equal to approximately 50%, of the width of each of the first and second lateral passage openings 17, 18.

As shown on FIG. 5, the front scraping member 13 includes a plurality of scraping areas 19 distributed along the front scraping member 13 and configured to scrape the surface to be cleaned, and a plurality of notched areas 21 distributed along the front scraping member 13 and provided with notches, also called crenels.

The plurality of scraping areas more particularly includes a plurality of first scraping areas 19.1 distributed along the first scraping branch 14, and a plurality of second scraping areas 19.2 distributed along the second scraping branch 15. Advantageously, the sum of the lengths of the first scraping areas 19.1 is greater than 50%, and for example greater than 70%, of the length of the first scraping branch 14, and the sum of the lengths of the second scraping areas 19.2 is greater than 50%, and for example greater than 70%, of the length of the second scraping branch 15.

According to the embodiment represented on the figures, the first scraping branch 14 includes an alternation of notched areas 21 and first scraping areas 19.1, and the second scraping branch 15 also includes an alternation of notched areas 21 and second scraping areas 19.2. The first scraping branch 14 may for example include two notched areas 21 and two first scraping areas 19.1, and the second scraping branch 15 may for example include two notched areas 21 and two second scraping areas 19.2.

According to the embodiment represented on the figures, the central passage opening 16 is delimited by two notches provided respectively on the first and second scraping branches 14, 15 and located respectively at the internal end portions of the first and second scraping branches 14, 15. However, according to one variant of the invention not represented on the figures, the first and second scraping branches 14, 15 could be spaced apart, and the central passage opening 16 could be delimited at least in part by internal edges of the first and second scraping branches 14, 15. According to such a variant of the invention, the first and second scraping branches 14, 15 would be devoid of notch at their internal end portions.

According to the embodiment represented on the figures, the or each of the first lateral passage openings 17 is defined by a notch provided on the first scraping branch 14, and the or each of the second lateral passage openings 18 is defined by a notch provided on the second scraping branch 15.

As shown on FIG. 5, the first scraping branch 14 includes a primary internal branch part 14.1 having a length corresponding substantially to half the length of the first scraping branch 14 and a primary external branch part 14.2 having a length corresponding substantially to half the length of the first scraping branch 14, and the second scraping branch 15 includes a secondary internal branch part 15.1 having a length corresponding substantially to half the length of the second scraping branch 15 and a secondary external branch part 15.2 having a length corresponding substantially to half the length of the second scraping branch 15.

Advantageously, a first opening rate of the primary internal branch part 14.1 is comprised between 23 and 71%, for example between 30 and 60%, and preferably between 40 and 50%, and a second opening rate of the secondary internal branch part 15.1 is comprised between 23 and 71%, for example between 30 and 60%, and preferably between 40 and 50%. The first opening rate is defined by the ratio between the length of the notched area 21 or the sum of the lengths of the notched areas 21 provided on the primary internal branch part 14.1 and half the length of the first scraping branch 14, while the second opening rate is defined by the ratio between the length of the notched area 21 or the sum of the lengths of the notched areas 21 provided on the secondary internal branch part 15.1 and half the length of the second scraping branch 15.

According to the embodiment represented on the figures, the primary external branch part 14.2 and the secondary external branch part 15.2 are devoid of notched area 21.

As shown on FIG. 3, the vacuum cleaner nozzle 2 further comprises a rear scraping member 22, such as a rear scraping brush, located at the rear of a rear edge 5.2 of the suction channel 5. The rear scraping member 22 extends substantially parallel to the direction of extension D1 of the suction channel 5.

However, according to one embodiment not represented on the figures, the rear scraping member 22 could include a central part extending substantially parallel to the direction of extension D1 of the suction channel 5, and a first lateral portion and a second lateral portion disposed on either side of the central part of the rear scraping member and inclined relative to each other. The first and second lateral portions could for example diverge relative to each other in the direction of a rear edge of the sole 3.

Of course, the present invention is in no way limited to the embodiments described and illustrated which have only been given by way of examples. Modifications remain possible, particularly from the point of view of the constitution of the various elements or by substitution of technical equivalents, without departing from the scope of protection of the invention.

The invention claimed is:

1. A vacuum cleaner nozzle comprising:

a sole including a lower face configured to be oriented towards a surface to be cleaned and a suction channel emerging into the lower face of the sole, a front scraping member located at the front of a front edge of the suction channel and delimiting at least in part a central passage opening which is fluidly connected to the suction channel, the front scraping member having a generally V-shape having an apex oriented towards a central part of the suction channel, the front scraping member including a first scraping branch which is elongated and which extends in a first direction of extension and a second scraping branch which is elongated and which extends in a second direction of extension, the first and second scraping branches being configured to orient waste, coming into contact against the front scraping member during a forward movement of the vacuum cleaner nozzle, towards the central passage opening, wherein the first and second directions of extension are inclined relative to each other by an angle of inclination comprised between 165° and 178°.

2. The vacuum cleaner nozzle according to claim 1, wherein the front scraping member includes at least one first lateral passage opening provided on the first scraping branch and fluidly connected to the suction channel, and at least one second lateral passage opening provided on the second scraping branch and fluidly connected to the suction channel, the at least one first lateral passage opening and the at least one second lateral passage opening being disposed on either side of the central passage opening.

3. The vacuum cleaner nozzle according to claim 2, wherein the at least one first lateral passage opening and the at least one second lateral passage opening are disposed symmetrically with respect to a median longitudinal plane of the vacuum cleaner nozzle.

4. The vacuum cleaner nozzle according to claim 2, wherein the central passage opening has a width less than the width of each of the first and second lateral passage openings.

5. The vacuum cleaner nozzle according to claim 1, wherein the front scraping member includes a plurality of notched areas distributed along the front scraping member and provided with notches defining the at least one first lateral passage opening and the at least one second lateral passage opening.

6. The vacuum cleaner nozzle according to claim 5, wherein:

the first scraping branch includes a primary internal branch part having a length corresponding substantially to half the length of the first scraping branch and a primary external branch part having a length corresponding substantially to half the length of the first scraping branch, a first opening rate of the primary internal branch part of the first scraping branch being comprised between 23 and 71%, the first opening rate being defined by the ratio between the length of the notched area or the sum of the lengths of the notched areas provided on the primary internal branch part of the first scraping branch and half the length of the first scraping branch, the second scraping branch includes a secondary internal branch part having a length corresponding substantially to half the length of the second scraping branch and a secondary external branch part having a length corresponding substantially to half the length of the second scraping branch, a second opening rate of the secondary internal branch part of the second scraping branch being comprised between 23 and 71%, the second opening rate being defined by the ratio between the length of the notched area or the sum of the lengths of the notched areas provided on the secondary internal branch part of the second scraping branch and half the length of the second scraping branch.

7. The vacuum cleaner nozzle according to claim 1, wherein the front scraping member includes a plurality of scraping areas distributed along the front scraping member and configured to scrape the surface to be cleaned.

8. The vacuum cleaner nozzle according to claim 7, wherein the plurality of scraping areas includes a plurality of first scraping areas distributed along the first scraping branch, and a plurality of second scraping areas distributed along the second scraping branch.

9. The vacuum cleaner nozzle according to claim 8, wherein the front scraping member includes a plurality of notched areas distributed along the front scraping member and provided with notches defining the at least one first lateral passage opening and the at least one second lateral passage opening, and wherein the first scraping branch includes an alternation of notched areas and first scraping areas, and the second scraping branch includes an alternation of notched areas and second scraping areas.

10. The vacuum cleaner nozzle according to claim 8, wherein the sum of the lengths of the first scraping areas is greater than 50% of the length of the first scraping branch, and the sum of the lengths of the second scraping areas is greater than 50% of the length of the second scraping branch.

11. The vacuum cleaner nozzle according to claim 1, wherein the front scraping member is a front scraping brush.

12. The vacuum cleaner nozzle according to claim 1, wherein the first and second scraping branches are distinct and separated from each other.

13. The vacuum cleaner nozzle according to claim 1, wherein the front scraping member extends along the front edge of the suction channel.

14. The vacuum cleaner nozzle according to claim 1, wherein the front scraping member is movable between a lowered position in which the front scraping member projects from the lower face of the sole and is configured to be in contact with the surface to be cleaned and a raised position in which the front scraping member is located back from the lower face of the sole and is configured to be located at a distance from the surface to be cleaned.

15. A domestic vacuum cleaner comprising a vacuum cleaner nozzle according to claim 14.

* * * * *